US012415695B2

(12) United States Patent
Tanaka

(10) Patent No.: US 12,415,695 B2
(45) Date of Patent: Sep. 16, 2025

(54) SHEET CONVEYANCE DEVICE AND IMAGE FORMING APPARATUS PROVIDED THEREWITH

(71) Applicant: KYOCERA Document Solutions Inc., Osaka (JP)

(72) Inventor: Yuichiro Tanaka, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 220 days.

(21) Appl. No.: 18/252,064

(22) PCT Filed: Nov. 4, 2021

(86) PCT No.: PCT/JP2021/040539
§ 371 (c)(1),
(2) Date: May 8, 2023

(87) PCT Pub. No.: WO2022/102501
PCT Pub. Date: May 19, 2022

(65) Prior Publication Data

US 2024/0010453 A1 Jan. 11, 2024

(30) Foreign Application Priority Data

Nov. 13, 2020 (JP) ..... 2020-189562

(51) Int. Cl.
*B65H 7/02* (2006.01)
*B65H 5/38* (2006.01)
*B65H 7/14* (2006.01)

(52) U.S. Cl.
CPC ..... *B65H 7/02* (2013.01); *B65H 5/38* (2013.01); *B65H 7/14* (2013.01);
(Continued)

(58) Field of Classification Search
CPC ... B65H 5/36; B65H 5/38; B65H 7/02; B65H 7/14; B65H 2301/5133; B65H 2401/15;
(Continued)

(56) References Cited

U.S. PATENT DOCUMENTS

2016/0033918 A1* 2/2016 Taniguchi ..... B65H 9/004 399/16
2018/0267454 A1* 9/2018 Uno ..... B65H 5/38
(Continued)

FOREIGN PATENT DOCUMENTS

JP H 04-112149 A 4/1992
JP H 04-157863 A 5/1992
(Continued)

*Primary Examiner* — Prasad V Gokhale
(74) *Attorney, Agent, or Firm* — Stein IP, LLC

(57) ABSTRACT

A sheet conveyance device includes a sheet conveyance passage, a mounting plate, and a sheet detection sensor. The mounting plate is fixed to a recessed portion formed in the inner wall surface of the sheet conveyance passage at its one side it. The sheet detection sensor is fitted on the mounting plate. The sheet detection sensor has a sensor surface. The mounting plate has a mounting surface on which the sheet detection sensor is mounted and a first projection piece which projects from the mounting surface toward the sheet conveyance passage and which is grounded. The first projection piece is disposed upstream, in the sheet conveyance direction, of the sheet detection sensor on the mounting plate. The distance from the mounting surface to the distal end of the first projection piece is greater than the distance from the mounting surface to the sensor surface.

6 Claims, 6 Drawing Sheets

(52) U.S. Cl.
CPC .. *B65H 2301/5133* (2013.01); *B65H 2401/15* (2013.01); *B65H 2401/21* (2013.01); *B65H 2515/70* (2013.01); *B65H 2553/414* (2013.01); *B65H 2553/80* (2013.01); *B65H 2801/06* (2013.01)

(58) Field of Classification Search
CPC ..... B65H 2401/21; B65H 2515/70; B65H 2553/414; B65H 2553/80; B65H 2553/82; B65H 2801/06
See application file for complete search history.

(56) References Cited

U.S. PATENT DOCUMENTS

| | | | | |
|---|---|---|---|---|
| 2019/0344987 | A1* | 11/2019 | Osawa ..... | B65H 7/125 |
| 2020/0231402 | A1 | 7/2020 | Ikeda | |
| 2023/0150278 | A1* | 5/2023 | Hanaoka ..... | B41J 13/076 347/104 |

FOREIGN PATENT DOCUMENTS

| | | | |
|---|---|---|---|
| JP | 2007-161435 | A | 6/2007 |
| JP | 2009-015625 | A | 3/2009 |
| JP | 2020-117328 | A | 8/2020 |

* cited by examiner

SHEET CONVEYANCE DEVICE AND IMAGE FORMING APPARATUS PROVIDED THEREWITH

CROSS-REFERENCE TO RELATED APPLICATIONS

This application is a national stage of International Application No. PCT/JP2021/040539, filed Nov. 4, 2021, which claims the benefit of Japanese Application No. 2020-189562, filed Nov. 13, 2020, in the Japanese Patent Office, the disclosures of which are incorporated herein by reference.

TECHNICAL FIELD

The present invention relates to a sheet conveyance device for conveying a sheet, and also to an image forming apparatus including a sheet conveyance device.

BACKGROUND ART

Some known image forming apparatuses, such as copiers, printers, facsimile machines, and multifunction peripherals having their functions integrated together, include a sheet stacking portion for placing a sheet on, an image forming portion for forming an image on the sheet, and a sheet conveyance device for conveying the sheet from the sheet stacking portion to the image forming portion.

Such sheet conveyance devices are generally provided with a sheet conveyance passage connected to the sheet stacking portion and to the image forming portion for conveyance of the sheet, and a sheet detection sensor provided between the sheet stacking portion and the image forming portion for detection of the passage of the sheet. The sheet detection sensor is an optical sensor including a sensor surface having a light-emitting portion and a light-receiving portion. The sheet detection sensor is fastened to the inner wall surface of the sheet conveyance passage at one side of it (the side closer to the main body of the image forming apparatus). The sensor surface is formed in an end surface of the sheet detection sensor and faces the inner wall surface of the sheet conveyance passage at the other side of it (farther from the main body than the just-mentioned one side).

The sheet detection sensor emits light from the light-emitting portion and senses in the light-receiving portion the light reflected from the sheet and the inner wall surface. The sheet detection sensor can read sheet information, such as the passing position of the sheet, from the sensing results such as the amount of reflected light and the timing of incidence. The image forming apparatus checks for sheet emptiness, sheet jams, and the like in a control portion connected to the sheet detection sensor and, based on the sensing results from the sheet detection sensor, notifies the user of the check results.

Here, the sheet may become electrostatically charged by friction between sheets when it is fed from the sheet stacking portion to the sheet conveyance passage. If the electrostatically charged sheet passes near the above-mentioned sheet detection sensor, electric discharge may occur from the sheet to the sheet detection sensor. This electric discharge may cause malfunction or breakdown of the sheet detection sensor. Even if a single occurrence of electric discharge may not cause malfunction or breakdown, if a large number of sheets pass near the sheet detection sensor and cause multiple occurrences of electric discharge, that may cause malfunction or breakdown of the sheet detection sensor.

To solve the problem, Patent Document 1 discloses a sheet conveyance device in which the surface (side and end faces) of a sheet detection sensor is covered with a metal mounting plate. The mounting plate is fixed to a main body portion of the image forming apparatus and is grounded. A through-hole is formed in the part of the mounting plate which covers the end face of the sheet detection sensor. A projection portion which projects through the through-hole outward of the mounting plate is provided on the end face of the sheet detection sensor. At the tip of the projection portion, a sensor surface as mentioned above is formed (see Patent Document 1, FIG. 2).

In this way, a large part of the surface of the sheet detection sensor is covered with the grounded mounting plate. Thus, even if an electrostatically charged sheet passes near the sheet detection sensor, electric discharge is more likely to occur from the sheet to the mounting plate and this helps suppress malfunction or breakdown of the sheet detection sensor.

Patent Document 2 discloses a sheet conveyance device in which a sheet detection sensor is disposed on a mounting plate and an antistatic brush is provided on the mounting plate. The antistatic brush is grounded and is provided downstream of the sheet detection sensor in the sheet conveyance direction. A sheet that passes through the sheet conveyance passage makes contact with the antistatic brush and is conveyed to an image forming portion. Thus, even if an electrostatically charged sheet passes near the sheet detection sensor, the static electricity on the sheet is removed by the antistatic brush. This helps suppress an increase in the amount of electricity on the sheet detection sensor and thereby suppress malfunction or breakdown of the sheet detection sensor.

CITATION LIST

Patent Literature

Patent Document 1: Japanese Unexamined Patent Application Publication No. 2007-161435

Patent Document 2: Japanese Unexamined Patent Application Publication No. 4-157863

SUMMARY OF INVENTION

Technical Problem

The projection portion in Patent Document 1 projects through the through-hole in the mounting plate outward of the mounting plate. That is, the distance of the sheet passing through the sheet detection sensor from the projection portion is smaller than the distance of the sheet from the mounting plate. For this reason, if the sheet is electrostatically charged, electric discharge may occur from the sheet to the sheet detection sensor. Thus, the sheet conveyance device of Patent Document 1 is not free from malfunction or breakdown of the sheet detection sensor.

The antistatic brush in Patent Document 2 is provided downstream of the sheet detection sensor in the sheet conveyance direction. For this reason, the sheet approaches the sheet detection sensor before the antistatic brush does. Then before the static electricity on the sheet is removed by the antistatic brush, electric discharge may occur from the sheet to the sheet detection sensor. Thus, also the sheet conveyance device of Patent Document 2 is not free from malfunction or breakdown of the sheet detection sensor.

While the above discussion deals with, as an example, breakdown and the like of a sheet detection sensor in a sheet conveyance device provided in an image forming apparatus, similar problems occur also in a relay conveyance device connected to an image forming apparatus, a sheet conveyance device provided in a sheet post-processing device, and the like.

Against the background discussed above, an object of the present invention is to suppress electric discharge from a sheet to a sheet detection sensor and thereby suppress malfunction or breakdown of a sheet conveyance device.

Solution to Problem

A first configuration of the present invention for achieving the above object is a sheet conveyance device including a sheet conveyance passage, a mounting plate, and a sheet detection sensor. The sheet conveyance device conveys a sheet. The mounting plate is fixed to a recessed portion formed in the inner wall surface of the sheet conveyance passage at its one side. The sheet detection sensor is fitted on the mounting plate and detects the passage of the sheet. The sheet detection sensor has a sensor surface facing the sheet conveyance passage. The mounting plate has a mounting surface on which the sheet detection sensor is mounted and a first projection piece which projects from the mounting surface to the sheet conveyance passage and which is grounded. The first projection piece is disposed upstream, in the sheet conveyance direction, of the sheet detection sensor on the mounting plate and the distance from the mounting surface to the distal end of the first projection piece is greater than the distance from the mounting surface to the sensor surface.

Advantageous Effects of Invention

According to the first configuration of the present invention, the distance from the mounting surface to the distal end of the first projection piece is greater than the distance from the mounting surface to the sensor surface, and thus the gap between the tip of the first projection piece and the sheet conveyance passage is narrower than the gap between the sensor surface and the sheet conveyance passage. The first projection piece is provided upstream of the sheet detection sensor. Thus, when a sheet to be conveyed passes near the sheet detection sensor, it approaches the distal end of the first projection piece before it does the sensor surface. Then, if the sheet is electrostatically charged, electric discharge preferentially occurs to the first projection piece than to the sheet detection sensor. This helps suppress malfunction or breakdown of the sheet conveyance device.

DESCRIPTION OF EMBODIMENTS

Figure 1:
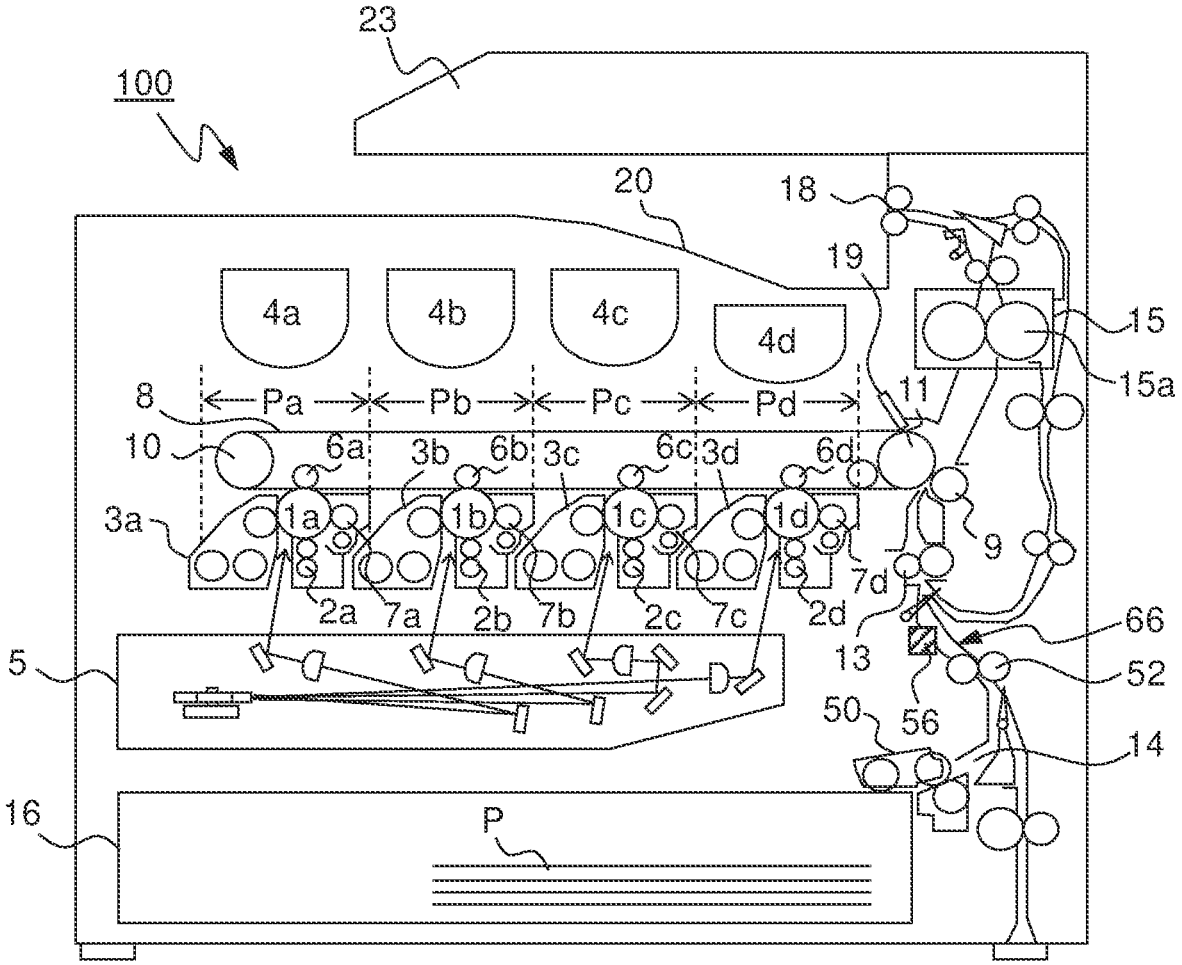
FIG. 1 is a sectional view showing a schematic configuration of an image forming apparatus 100 including a sheet conveyance device 66 according to a first embodiment of the present invention.

Hereinafter, a first embodiment of the present invention will be described with reference to the drawings. FIG. 1 is a sectional view showing a schematic configuration of an image forming apparatus 100 including a sheet conveyance device 66 according to the present invention. In this embodiment, the image forming apparatus 100 is a quadruple tandem-type color copier which performs image formation with four photosensitive drums 1*a*, 1*b*, 1*c*, and 1*d* arranged side by side corresponding to four different colors (magenta, cyan, yellow, and black).

Inside the image forming apparatus 100, four image forming portions Pa, Pb, Pc, and Pd are arranged in this order from the left side in FIG. 1. These image forming portions Pa to Pd are provided to correspond to images of four different colors (magenta, cyan, yellow, and black) and sequentially form images of magenta, cyan, yellow, and black, each through the processes of electrostatic charging, exposure to light, image development, and image transfer.

In the image forming portions Pa to Pd, the above-mentioned photosensitive drums 1*a* to 1*d* which carry visible images (toner images) of the different colors are arranged respectively and an intermediate transfer belt 8 which rotates counterclockwise in FIG. 1 is provided adjacent to each image forming portions Pa to Pd. The toner images formed on these photosensitive drums 1*a* to 1*d* are sequentially transferred to the intermediate transfer belt 8 which moves while making in contact with each of the photosensitive drums 1*a* to 1*d*, are then at once transferred to a sheet P at a secondary transfer roller 9, and are then fixed to the sheet P at a fixing device 15. The sheet P is then discharged out from the image forming apparatus 100. Image forming process is performed to each photosensitive drums 1*a* to 1*d* while rotating them clockwise in FIG. 1.

A sheet cassette 16 (sheet stacking portion) with sheets P (sheets) stacked in it is provided in a lower part of the image forming apparatus 100. A sheet conveyance passage 14 (sheet conveyance passage) is connected to the sheet cassette 16. The sheet conveyance passage 14 extends upward from the sheet cassette 16. A feed portion 50 is provided in an upstream end part of the sheet conveyance passage 14 (in a part of it connected with the sheet cassette 16). The feed portion 50 feeds out the sheets P stacked in the sheet cassette 16 to the sheet conveyance passage 14. Midway along the sheet conveyance passage 14 are provided a conveyance roller 52, a pair of registration rollers 13, the above-mentioned secondary transfer roller 9, and the fixing device 15 are provided in order from the bottom.

Used as the intermediate transfer belt 8 is a sheet of a dielectric resin and typically a belt without a seam (seamless belt). The intermediate transfer belt 8 and the secondary transfer roller 9 are driven by a belt driving motor (not illustrated) to rotate at the same linear velocity as the photosensitive drums 1*a* to 1*d*. A blade-form belt cleaner 19 for removing toner and the like remaining on the surface of the intermediate transfer belt 8 is disposed downstream of the secondary transfer roller 9.

Next, the image forming portions Pa to Pd will be described. Around and below the photosensitive drums 1*a* to 1*d*, which are provided rotatably, the following components are provided: charging devices 2*a*, 2*b*, 2*c*, and 2*d* for electrostatically charging the photosensitive drums 1*a* to 1*d*; an exposure unit 5 for exposing the photosensitive drums 1*a* to 1*d* to light based on image data; development devices 3*a*, 3*b*, 3*c*, and 3*d* for developing electrostatic latent images formed on the photosensitive drums 1*a* to 1*d* with toner; and cleaning devices 7*a*, 7*b*, 7*c*, and 7*d* for collecting and removing developer (toner) remaining after the transfer of the toner image to the photosensitive drums 1*a* to 1*d*.

An image reading portion 23 includes a scanning optical system which incorporates a scanner lamp for illuminating a document during copying and a mirror for changing the optical path of the light reflected from the document; a condenser lens for converging and focusing the light reflected from the document; a CCD sensor for converting the focused image light into an electric signal; and the like (of which none are illustrated). The image reading portion 23 reads a document image and converts it into image data.

In copy operation, the image reading portion 23 reads the image data of a document and converts it into an image signal. The charging devices 2*a* to 2*d* electrostatically charge the surfaces of the photosensitive drums 1*a* to 1*d* uniformly. Next, the exposure unit 5 performs light irradiation based on the read image data and forms electrostatic latent images on the photosensitive drums 1*a* to 1*d* according to the image data. The development devices 3*a* to 3*d* include development rollers (developer carriers) disposed so as to face the photosensitive drums 1*a* to 1*d* and are loaded with predetermined amounts of two-component developer containing toner of different colors, namely magenta, cyan, yellow, and black respectively.

When the proportion of the toner in the two-component developer in the development devices 3*a* to 3*b* falls below a prescribed value as toner image as will be described later, developer is fed from containers 4*a* to 4*d* to the development devices 3*a* to 3*d*. The toner in the developer is fed from the development devices 3*a* to 3*d* to the photosensitive drums 1*a* to 1*d* and electrostatically adhere to them; thus, toner images are formed according to the electrostatic latent images formed by exposure to light from the exposure unit 5.

Then, a predetermined transfer voltage is applied from the primary transfer rollers 6*a* to 6*d* between the primary transfer rollers 6*a* to 6*d* and the photosensitive drums 1*a* to 1*d*, and thereby the toner images of magenta, cyan, yellow, and black on the photosensitive drums 1*a* to 1*d* are primarily transferred to the intermediate transfer belt 8. These images of four colors are formed with a predetermined positional relationship previously determined to form a full-color image. The primary transfer rollers 6*a* to 6*d* are driven by a primary transfer driving motor (not illustrated) to rotate at the same linear velocity as the photosensitive drums 1*a* to 1*d*. After that, in preparation for the subsequent formation of new electrostatic latent images, the toner remaining on the surfaces of photosensitive drums 1*a* to 1*d* is removed by the cleaning devices 7*a* to 7*d*.

The intermediate transfer belt 8 is wound around a driven roller 10 and a driving roller 11, and when the intermediate transfer belt 8 starts rotating counterclockwise as the driving roller 11 is rotated by the above-mentioned belt driving motor, the sheet P is conveyed with predetermined timing from the pair of registration rollers 13 to a nip portion (secondary transfer nip portion) between the secondary transfer roller 9 and the intermediate transfer belt 8, and a full-color toner image is secondarily transferred to the sheet P at the nip portion. The sheet P with the toner image transferred to it is conveyed through the sheet conveyance passage 14 to the fixing device 15.

The sheet P conveyed to the fixing device 15 is heated and pressed while passing through a nip portion (fixing nip portion) in a pair of fixing rollers 15*a*. At this time, the toner image is fixed to the surface of the sheet P and the predetermined full-color image is formed. The sheet P with the full-color image formed on it is discharged to a discharge tray 20 provided on the top face of the image forming apparatus 100 by a pair of discharge rollers 18. The direction in which the sheet P is conveyed from the sheet cassette 16 to the discharge tray 20 is referred to as the sheet conveyance direction. With respect to the sheet conveyance direction, the sheet cassette 16 side is referred to as the upstream side and the discharge tray 20 side is referred to as the downstream side.

Figure 2:
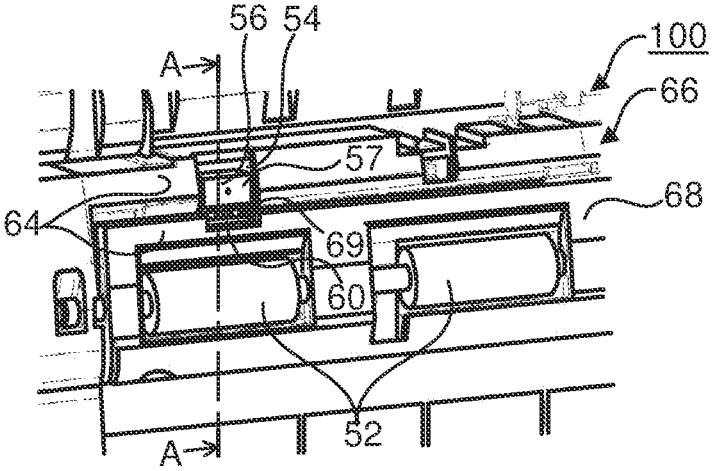
FIG. 2 is a perspective view around a conveyance roller 52.
Figure 3:
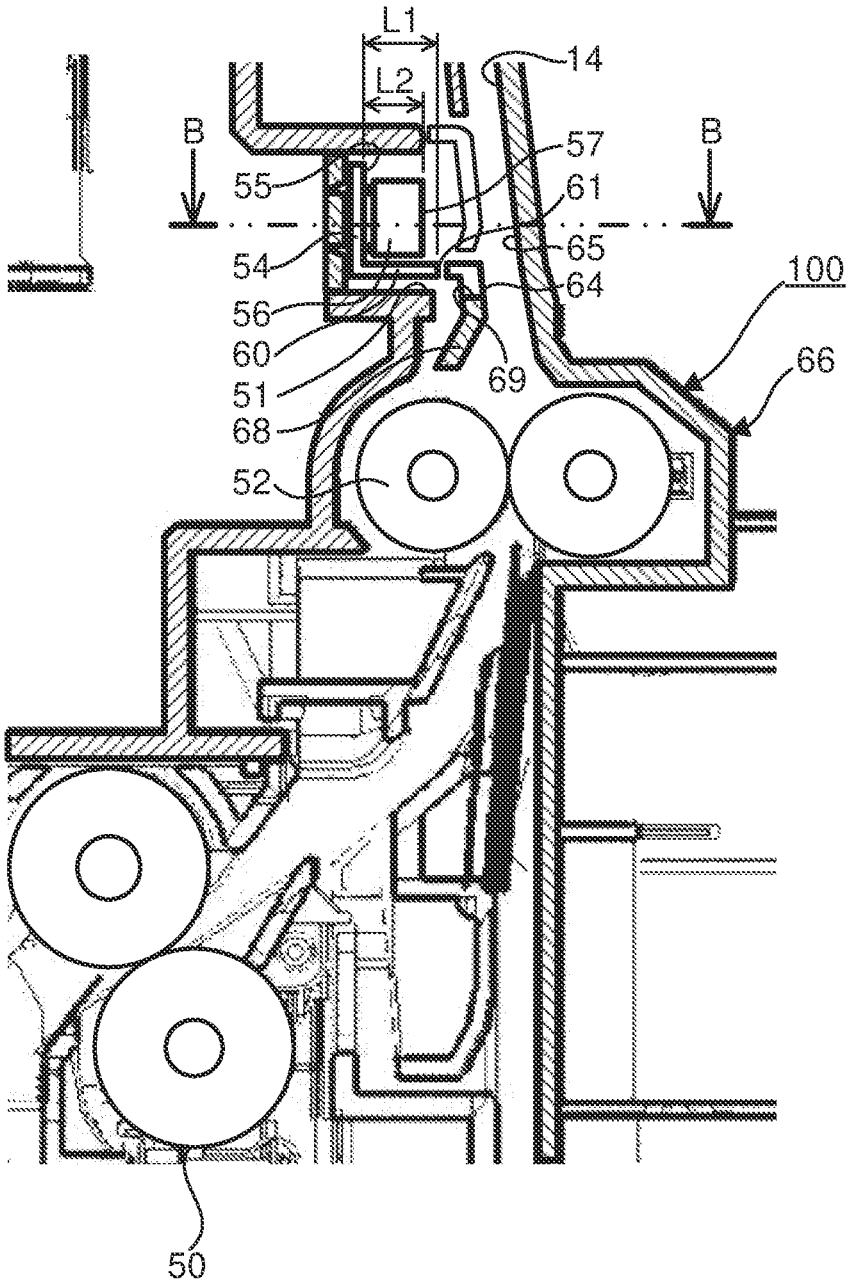
FIG. 3 is a sectional view of the sheet conveyance device 66 in FIG. 2 cut along section line A-A.
Figure 4:
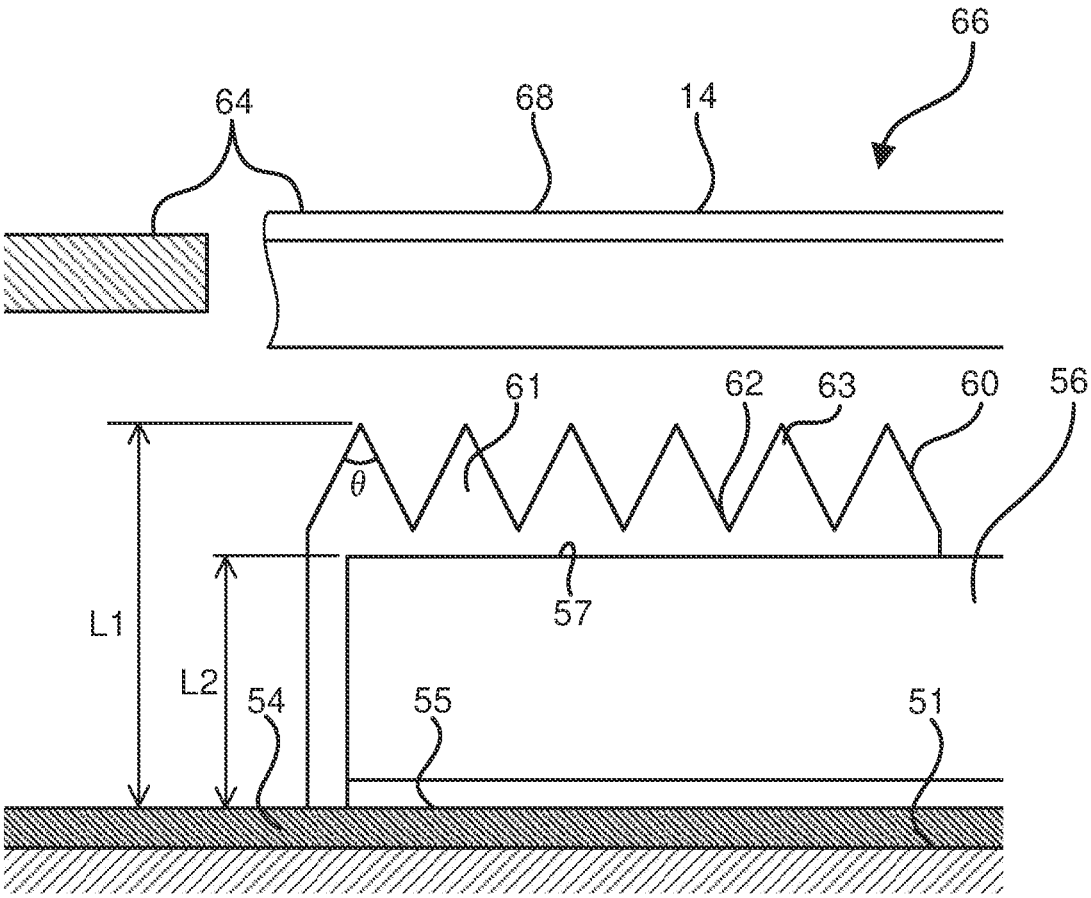
FIG. 4 is a sectional view of the sheet conveyance device 66 in FIG. 3 cut along section line B-B, showing a mounting plate 54 from the side.

FIG. 2 is a perspective view around the conveyance roller 52. FIG. 3 is a sectional view of the sheet conveyance device 66 in FIG. 2 cut along section line A-A. FIG. 4 is a sectional view of the sheet conveyance device 66 in FIG. 3 cut along section line B-B, showing a mounting plate 54 from the side. The inner wall surfaces of the sheet conveyance passage 14 include an inner surface 64 and an outer surface 65 that are located respectively at one and the other side opposite each other in the direction (left-right direction in FIG. 3) orthogonal to the sheet conveyance direction (i.e., the former inward in an apparatus main body of the image forming apparatus 100 and the latter outward in the apparatus main body of the image forming apparatus 100 with respect to the inner surface 64).

A conveyance guide 68 is disposed so as to overlap with one of the conveyance rollers 52 (see FIGS. 2 and 3). The conveyance guide 68 extends from upstream to downstream of conveyance rollers 52 with respect to the sheet conveyance direction. The conveyance guide 68 forms a part of the sheet conveyance passage 14 and the sheet conveyance passage 14 side surface of the conveyance guide 68 is a part of the inner surface 64. The conveyance guide 68 has a cutout portion 69 cut in from a downstream end part in the sheet conveyance direction upstream in the sheet conveyance direction.

In the inner surface 64, at a position upstream of the secondary transfer roller 9 (see FIG. 1) and downstream of the feed portion 50, a recessed portion 51 is formed that is recessed from the inner surface 64 inward (leftward in FIG. 3) of the image forming apparatus 100. Specifically, the recessed portion 51 is located at a position downstream of the feed portion 50 (here, downstream of the conveyance rollers 52) and upstream of the pair of registration rollers 13. The recessed portion 51 is a concave-form recess formed so as to be recessed from the inner surface 64 inward of the image forming apparatus 100.

To the bottom face of the recessed portion 51, a mounting plate 54 is fixed. The mounting plate 54 is a plate-form member formed of a conductive material such as a metal. The mounting plate 54 is grounded by being electrically connected to a grounding member (not illustrated) provided inside the image forming apparatus 100. The mounting plate 54 has a flat mounting surface 55 that faces the outer surface 65.

On the mounting surface 55, a sheet detection sensor 56 is placed and mounted. The sheet detection sensor 56 has a claw-form mounting portion (not illustrated) formed by resin material and the like. The mounting portion is, in an elastically deformed state, in contact with the mounting plate 54. The sheet detection sensor 56 is coupled to the mounting plate 54 so as to hold the mounting plate 54 by resilience of the mounting portion.

The mounting plate 54 has a first projection piece 60. The first projection piece 60 is a plate-form member projecting from the mounting surface 55 toward the outer surface 65. The first projection piece 60 is integrally formed with the mounting plate 54 by bending the mounting plate 54 into an L shape. The first projection piece 60 is positioned to at a position overlapping with the cutout portion 69 in the conveyance guide 68. The first projection piece 60 is increasingly narrow in the width direction (orthogonal to the sheet conveyance direction) of the mounting plate 54. A distal end portion 61 of the first projection piece 60 (an edge part of it located at the distal end of the first projection piece 60) (distal edge) is located at one side of the inner surface 64 (inward of the image forming apparatus 100). In other words, the first projection piece 60 does not reach the sheet conveyance passage 14.

The distal end portion 61 is formed in a sawtooth shape in which tooth base portions 62 and tooth tip portions 63 alternate in the width direction of the mounting plate 54 and that extends in the width direction of the mounting plate 54 (a shape in which a plurality of mountain-shaped projections are arrayed in the width direction of the mounting plate 54). The tooth base portions 62 recess from the end of the first projection piece 60 in its projection direction toward the inner surface 64. The tooth tip portions 63 extend from the bottoms of the tooth base portions 62 toward the sheet conveyance passage 14. The tooth tip portions 63 are formed to taper from the bottoms to the tips of the tooth base portions 62. The vertex angle θ at the tips of the tooth tip portions 63 is acute.

Figure 5:
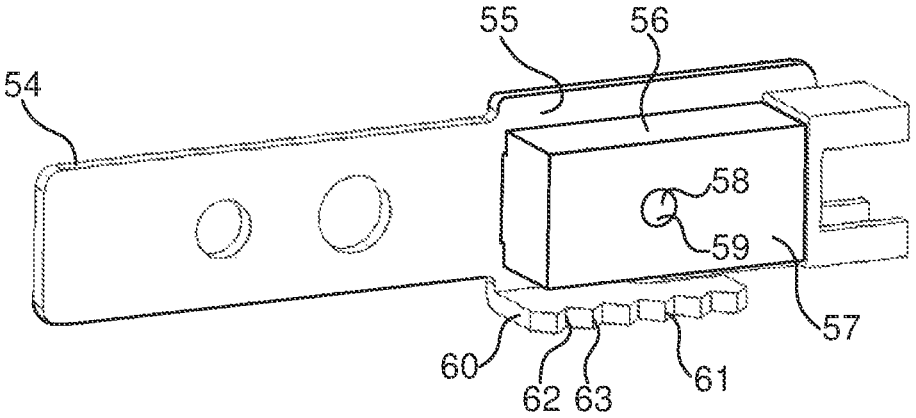
FIG. 5 is a perspective view showing the mounting plate 54 and a sheet detection sensor 56.

FIG. 5 is a perspective view showing the mounting plate 54 and the sheet detection sensor 56. The sheet detection sensor 56 is box-shaped (here, in the shape of a rectangular parallelepiped). The sheet detection sensor 56 has a sensor surface 57 formed at its end face in the direction opposite to the fitting direction of the sheet detection sensor 56 on the mounting plate 54. The sensor surface 57 faces the sheet conveyance passage 14. The distance L1 from the mounting surface 55 to the distal end of the first projection piece 60 (tooth tip portions 63) is greater than the distance L2 from the mounting surface 55 to the sensor surface 57 and the inner surface 64 (see FIGS. 3 and 4). That is, the gap between the distal end of the first projection piece 60 and the sheet conveyance passage 14 is narrower than the gap between the sensor surface 57 and the sheet conveyance passage 14. Thus, the sheet P in the sheet conveyance direction 14 is conveyed so as to pass nearer to the first projection piece 60 than the sensor surface 57. A light-emitting portion 58 and a light-receiving portion 59 is disposed at the sensor surface 57.

The sheet detection sensor 56 is connected to a control portion (not illustrated) in the image forming apparatus 100. Light emitted from the light-emitting portion 58 is reflected from the outer surface 65 and the sheet P during passing, and strikes the light-receiving portion 59. The sheet detection sensor 56 acquires sheet information from the amount of light incident on the light-receiving portion 59, the timing of the incidence, and the like. The above-mentioned control portion checks whether the sheet P has passed between the sensor surface 57 and the outer surface 65 based on the sensing results from the sheet detection sensor 56 and can notify the user of sheet emptiness and sheet jams in the sheet conveyance passage 14.

As described above, the distance L1 from the mounting surface 55 to the distal end of the first projection piece 60 is greater than the distance L2 from the mounting surface to the sensor surface 57, and thus the gap between the distal end of the first projection piece 60 and the sheet conveyance passage 14 is narrower than the gap between the sensor surface 57 and the sheet conveyance passage 14. The sheet projection piece 60 is provided upstream of the sheet detection sensor 56. Thus, after passing across the conveyance rollers 52, the sheet P approaches the tip of the first projection piece 60 before it does the sensor surface 57. If the sheet P is electrostatically charged, electric discharge may preferentially occur to the first projection piece 60 than to the sheet detection sensor 56. The first projection piece 60 is grounded, and thus the discharged current flows out of the image forming apparatus 100. This helps suppress malfunction or breakdown of the sheet detection sensor 56.

Owing to the plurality of tooth tip portions 63 being formed at the distal end portion 61 of the first projection piece 60, if the sheet P is electrostatically charged, electric discharge from the sheet P preferentially occur to the tooth tip portions 63 of the first projection piece 60. Giving the tooth tip portions 63 an acute angle makes electric discharge more likely to occur to the end of the tooth tip portion 63, and this helps suppress malfunction or breakdown of the sheet detection sensor 56 more effectively.

Figure 6:
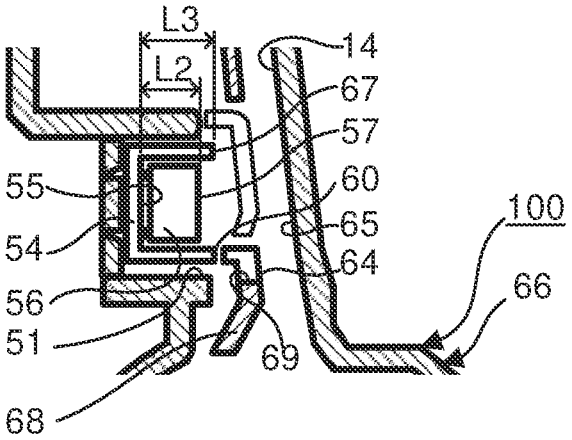
FIG. 6 is a part-enlarged view showing details around a mounting plate 54 in a sheet conveyance device 66 according to a second embodiment of the present invention.
Figure 7:
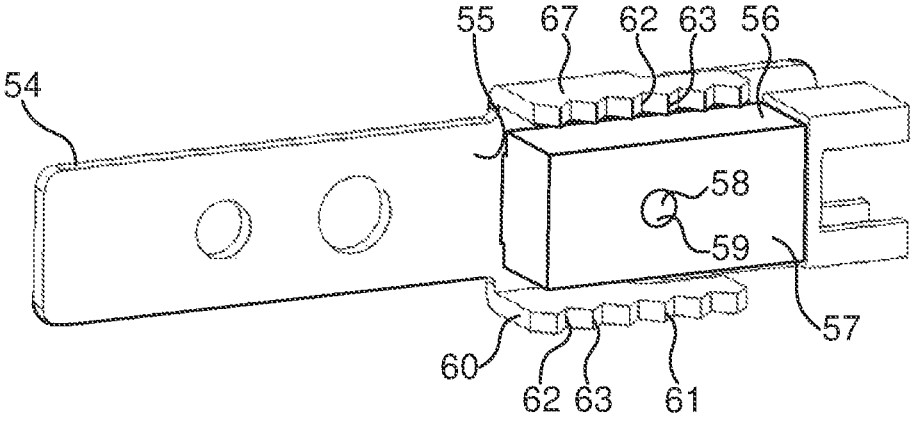
FIG. 7 is a perspective view showing the mounting plate 54 and a sheet detection sensor 56 according to the second embodiment.

Next, a sheet conveyance device 66 according to a second embodiment will be described in detail. FIG. 6 is an enlarged part view of details around a mounting plate 54 in the sheet conveyance device 66 according to the second embodiment of the present invention. FIG. 7 is a perspective view of the mounting plate 54 and a sheet detection sensor 56 according to the second embodiment.

The mounting plate 54 in the second embodiment includes a second projection piece 67 which is grounded. The second projection piece 67 is a plate-form member projecting from a mounting surface 55 toward the outer surface 65 of a sheet conveyance passage 14. The second projection piece 67 faces the first projection piece 60 in the sheet conveyance direction. The second projection piece 67 is increasingly narrow in the width direction of the mounting plate 54. A distal end portion of the second projection piece 67 is located at one side of an inner surface 64 (inward of an image forming apparatus 100). In other words, the second projection piece 67 does not reach the sheet conveyance passage 14. The distal end portion of the second projection piece 67 is, like the distal end portion 61 of the first projection piece 60, formed in a sawtooth shape in which tooth base portions 62 and tooth tip portions 63 alternate in the width direction of the mounting plate 54.

The distance L3 from the mounting surface 55 to the distal end of the second projection piece 67 is greater than the distance L2 from the mounting surface 55 to a sensor surface 57. That is, the gap between the distal end of the second projection piece 67 and the sheet conveyance passage 14 is narrower than the gap between the sensor surface 57 and the sheet conveyance passage 14. The distance L3 is equal to the distance L1 from the first projection piece 60 to the inner surface 64 (not illustrated).

Thus, even if an electrostatically charged sheet P passes near the sheet detection sensor 56, electric discharge is more likely to occur not only to the first projection piece 60 but also to the second projection piece 67 and this helps more effectively suppress electric discharge to the sheet detection sensor 56.

The present invention is not limited by the embodiments described above and allows for any modifications made without departure from the spirit of the present invention.

INDUSTRIAL APPLICABILITY

The present invention finds applications in sheet conveyance devices for conveying sheets, like those provided in image forming apparatuses such as copiers, printers, facsimile machines, and multifunction peripherals having their functions integrated together. According to the present invention, in a sheet conveyance device, when an electrostatically charged sheet P passes near a sheet detection sensor for acquiring information on the sheet, electric discharge is less likely to occur from the sheet to the sheet detection sensor. This helps suppress malfunction or breakdown of the sheet conveyance device.

The invention claimed is:

1. A sheet conveyance device comprising:

a sheet conveyance passage through which a sheet is conveyed;

a mounting plate fixed to a recessed portion formed in an inner wall surface of the sheet conveyance passage at one side thereof; and a sheet detection sensor mounted on the mounting plate, the sheet detection sensor detecting passage of the sheet, wherein the sheet detection sensor includes a sensor surface facing the sheet conveyance passage, the mounting plate includes:

a mounting surface on which the sheet detection sensor is mounted; and a first projection piece projecting from the mounting surface toward the sheet conveyance passage, the first projection piece being grounded, and the first projection piece is disposed at a position upstream, in a sheet conveyance direction, of the sheet detection sensor on the mounting plate and a distance from the mounting surface to a distal end of the first projection piece is greater than a distance from the mounting surface to the sensor surface, a distal edge of the first projection piece is formed in a shape in which a plurality of mountain-shaped projections, projecting in a direction orthogonal to the sheet conveyance direction, are arrayed in a width direction of the mounting plate orthogonal to the sheet conveyance direction and to a projecting direction of the projections.

2. The sheet conveyance device according to claim 1, wherein vertex angles of the projections on the distal edge are acute.

3. The sheet conveyance device according to claim 1, wherein the mounting plate includes:

a second projection piece disposed downstream of the sheet detection sensor in the sheet conveyance direction, the second projection piece projecting from the mounting surface toward the sheet conveyance passage, the second projection piece being grounded.

4. The sheet conveyance device according to claim 1, wherein a distal end portion of the first projection piece in a projection direction thereof is located in the recessed portion, inward of the inner wall.

5. The sheet conveyance device according to claim 1, wherein the mounting plate is a plate-form member formed of a metallic conductive material; and the first projection piece is formed integrally with the mounting plate as a result of the mounting plate being bent into an L shape.

6. An image forming apparatus comprising:

an image forming portion that forms an image on the sheet;

a sheet stacking portion on which the sheet is stacked; and the sheet conveyance device according to claim 1 that conveys the sheet from the sheet stacking portion to the image forming portion.

* * * * *